United States Patent [19]

Smallegan et al.

[11] Patent Number: 4,884,835

[45] Date of Patent: Dec. 5, 1989

[54] LEVER SPINDLE SPRING CAGE

[75] Inventors: Jon M. Smallegan, Colorado Springs, Colo.; Richard R. Bettger, San Francisco, Calif.

[73] Assignee: Schlage Lock Company, San Francisco, Calif.

[21] Appl. No.: 238,408

[22] Filed: Aug. 31, 1988

[51] Int. Cl.[4] ..... E05C 21/00

[52] U.S. Cl. ..... 292/357; 292/DIG. 64; 292/DIG. 53; 292/DIG. 61; 292/336.3; 292/244

[58] Field of Search ..... 292/357, 336.3, 347, 292/244, 245, DIG. 61, DIG. 53, DIG. 64

[56] References Cited

U.S. PATENT DOCUMENTS

| | | | |
|---|---|---|---|
| 1,544,229 | 6/1925 | Edgar | 292/357 X |
| 1,994,134 | 3/1935 | Henst | 292/357 X |
| 2,759,754 | 8/1956 | Kaiser | 292/357 X |
| 2,805,880 | 9/1957 | Brozek et al. | 292/357 |
| 3,107,113 | 10/1963 | Sconzo | 292/357 X |
| 4,453,753 | 6/1984 | Fayerman et al. | 292/357 X |

*Primary Examiner*—Richard E. Moore

*Attorney, Agent, or Firm*—Walter C. Vliet

[57] ABSTRACT

Disclosed is a means to provide easily installed and accurately aligned lever spring cage for door hardware locks and latches by in the field installers. The device comprises a pair of posts, selectively arranged and mounted in a mounting plate, having four diagonally arranged key hole shaped bosses which accept the pins and in combination with accurate holes in the spring cage effect both the securing and alignment of the spring cage relative to the mounting plate.

1 Claim, 2 Drawing Sheets

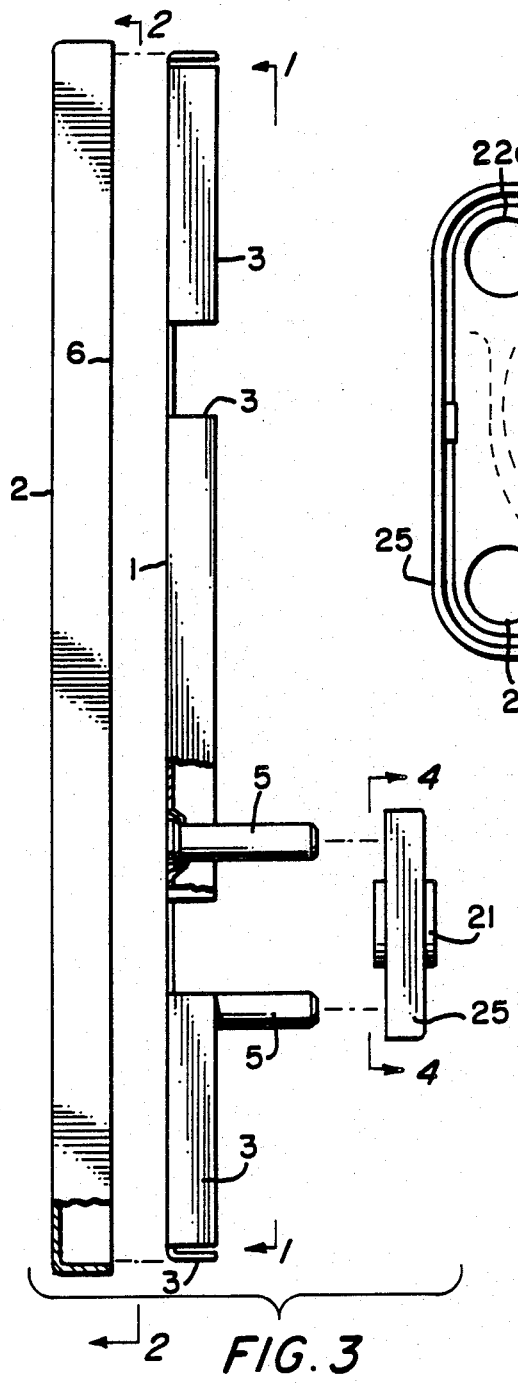
FIG. 3
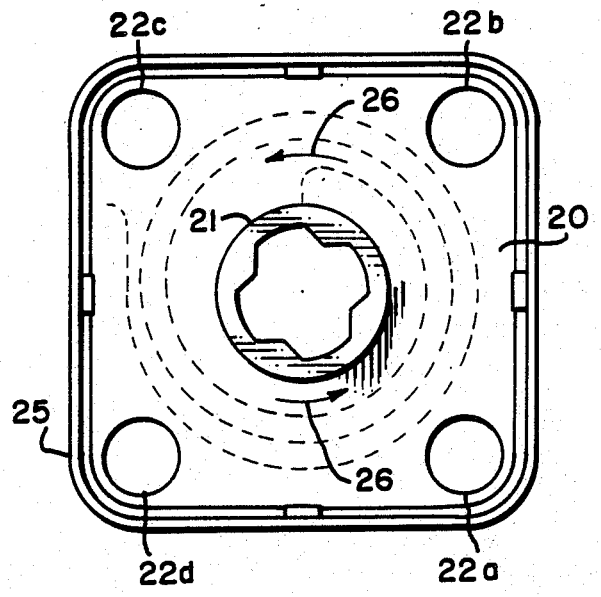
FIG. 4
FIG. 5
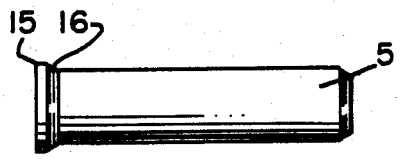

LEVER SPINDLE SPRING CAGE

BACKGROUND OF THE INVENTION

This invention pertains to door trim and in particular it pertains to door trim for lever handles providing a means for returning the handles in a preferred horizontal position. In the past this has been accomplished by fixed spring means, and the like, and further such spring means have not been readily installed in the field by installers where such installation is required to accommodate different handed door operations

OBJECT OF THE PRESENT INVENTION

It is therefore an object of the present invention to provide a spring cage assembly and a mounting and alignment means therefore which is readily installed, accurately aligned, and serves to align the lever handle more accurately in its referred position It is particularly an object of this invention to set forth a lever handle door trim comprising: a mounting plate having a plurality of removable post inserted in a plurality of radially aligned bushing means, said bushing means further comprising radially oriented slots having at one end a greater dimension for accepting the head of a post therethrough and a lesser dimension radially inward for retaining said post head, said post further cooperating with a spring cage means having bores for accepting said post means whereby on assembly said post cooperate with said bushing means and said bore means to accurately align and secure said spring cage means to said mounting plate means.

Further objects of this invention as well as novel features thereof will become more apparent by reference to the following description taken in conjunction with the accompanying figures.

BRIEF DESCRIPTION OF THE DRAWINGS

FIG. 3 is a side elevation showing the exploded assembly of the escutcheon mounting plate, posts and spring cage according to the present invention.

FIG. 4 is a plan view of the spring cage assembly showing the relative locations of the spindle hole and post bores.

FIG. 5 is an enlarged view of the novel posts according to the present invention.

DESCRIPTION OF THE PREFERRED EMBODIMENT

Figure 1:
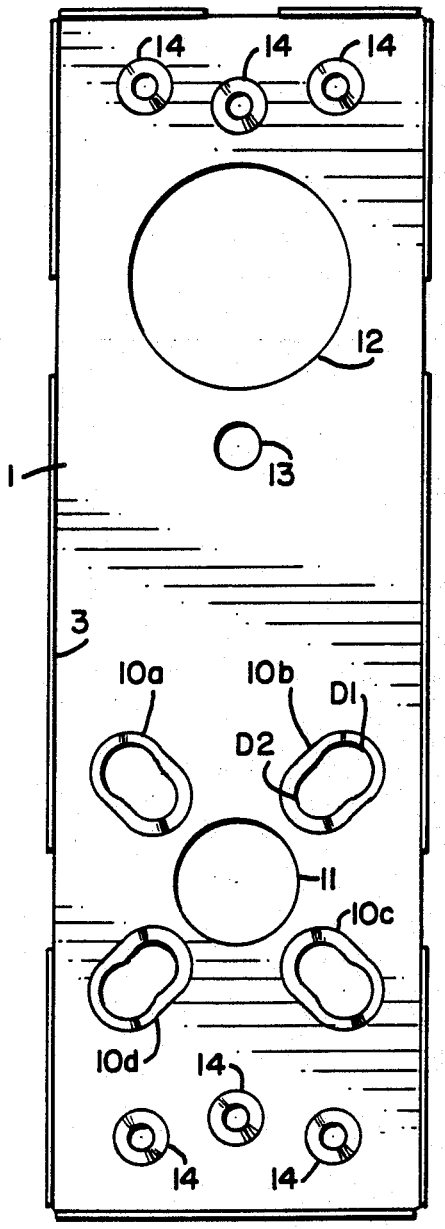
FIG. 1 is a plan view of the mounting plate according to the present invention.

Referring to FIG. 1, a mounting plate 1 which is part of the lock trim is shown formed of a stamped material such as steel or brass. The mounting plate has formed on each peripheral edge a bent up lip 3 which provides reinforcement to the plate and stiffness as required. A cover or rectangular escutcheon trim or rose plate 2 is also shown which is mounted in covering contact relationship with the mounting plate 1. The formed peripheral edge 6 of the rose plate 2 encloses the lip 3 of the mounting plate on its side in close fitting relationship. As can be seen best in FIG. 1, the mounting plate 1 is provided with a series of perforations for mounting various lock components.

In a typical lever lock construction the lever handle escutcheon bushing is mounted in perforation 11 and forms a trunnion bushing about which the lever handle may rotate. Perforation 12 may provide access to a cylindrical lock cylinder or the like. Perforation 13 may provide access to an occupancy indicator or the like while perforations 14 provide means for mounting the mounting plate and the escutcheon 2.

To this point the components described are of relatively conventional construction known in the industry. As previously mentioned, however, in the case of lever locks, in particular, it is difficult to assemble and align the lever spindle in the field without attendant problems associated with alignment and tolerances which commonly result in "lever droop". For this reason, according to the present invention, the mounting plate is provided with a series of keyhole perforations or slots 10*a* through 10*d* which are oriented about diagonal radials extending from the lever spindle perforation 11.

As best seen in FIG. 3, the keyhole slots 10*a* through 10*d* are oriented radially about the lever bushing mounting hole 11 and are formed in such a way as to have a major diameter D1 formed radially outward of a minor diameter D2. In this manner the mounting pins 5 best seen in FIG. 5, with the beveled head 15, may be inserted in the diameter D1, and moved radially inward to the diameter D2 portion of the keyhole slot wherein the beveled head 15 is trapped.

The bevel 16 on mounting pin 5, cooperating with the minor diameter and a corresponding beveled portion of diameter D2, retain the pin in its radially oriented and axially fixed position.

The spring cage 25, with its corresponding spring cage hub 21, may now be inserted over any two or more diametrically opposed mounting pins set in their radially inward position. The mounting pins are accepted by the mounting holes 23*a* through 23*c* in the spring cage as best seen on FIG. 4. The spring cage 25 may be mounted with either side towards the mounting plate 1 depending on the hand of rotation selected. Arrows 26 stamped on the spring cage 25 aid in selection of direction of rotation. It may now be appreciated by one skilled in the art that once the spring cage is in place over the mounting pins, direction of rotation is selected and the spring cage is now oriented by the mounting pins and further the mounting pins are locked into position radially, axially and diametrically thereby preventing movement of the spring cage. The four holes are provided to allow reverse handing of the lock with ease of assembly. Only two opposite pins are required, however, to set the spring cage.

Figure 2:
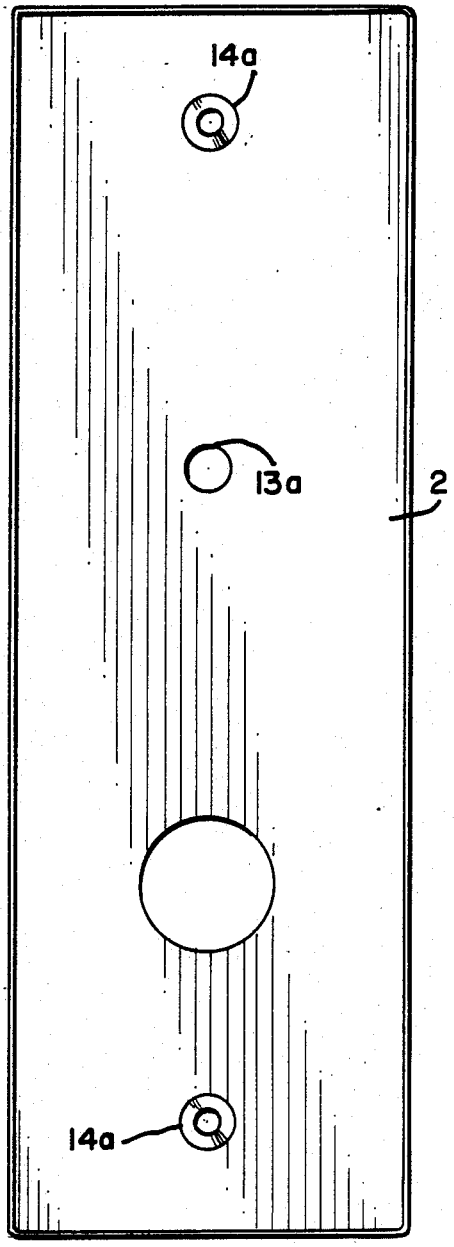
FIG. 2 is a plan view of an escutcheon trim having means thereon for securing it to said mounting plate.

The lock may now be assembled by means of fastening devices inserted through the various mounting holes provided, i.e., mounting holes 14 in FIG. 1 and LA in FIG. 2 to assemble a lock package. The mounting pins further serve as means of orienting the lock internals relative to the spring cage and the spring cage hub having an accurate splined bore for accepting the lock spindle to which the handle is attached now form a cooperating structure with the spring cage to both orient the handle and prevent lever droop relative to the lock mechanism.

As may be appreciated by one skilled in the art this simple method of assembly and reliable means of orientation greatly facilitate the assembly of the lock and its function and appearance.

Having described our invention in terms of a preferred embodiment we do not wish to be limited in the scope of our invention except a claimed.

We claim:

1. A lever spindle spring cage mounting comprising: a spring means; a means for mounting said spring means relative to a lock means; said spring means being further provided with a means for accepting a lock spindle, the spring mounting means further comprising a plurality of pin means; said pin means being inserted in a lock mounting in a radial orientation about the axis of rotation of a lock spindle; said plurality of mounting pins being further disposed in a plurality of keyhole mounting means; and said pin means further cooperating with radially disposed holes in said spring cage for aligning said spring cage relative to said lock mounting means; and said lock mounting means and said mounting pins and said spring means further cooperate to radially orient and diametrically fix the spring means about the axis of said spindle means.

* * * * *